US011649581B2

(12) United States Patent
Kitayama et al.

(10) Patent No.: US 11,649,581 B2
(45) Date of Patent: May 16, 2023

(54) CLOTHES TREATING APPARATUS

(71) Applicant: Samsung Electronics Co., Ltd., Suwon-si (KR)

(72) Inventors: Naoki Kitayama, Kanagawa (JP); Shigenori Hato, Kanagawa (JP); Kazushi Mori, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 17/125,169

(22) Filed: Dec. 17, 2020

(65) Prior Publication Data

US 2021/0198836 A1 Jul. 1, 2021

(30) Foreign Application Priority Data

Dec. 27, 2019 (JP) ..... JP2019-239542
Nov. 19, 2020 (KR) ..... KR10-2020-0155335

(51) Int. Cl.
*D06F 58/10* (2006.01)
*D06F 34/26* (2020.01)
(Continued)

(52) U.S. Cl.
CPC ..... *D06F 58/10* (2013.01); *D06F 34/26* (2020.02); *D06F 59/02* (2013.01); *D06F 2105/22* (2020.02); *D06F 2105/30* (2020.02)

(58) Field of Classification Search
CPC ..... D06F 58/10; D06F 58/20; D06F 58/206; D06F 58/30; D06F 58/203; D06F 34/26;
(Continued)

(56) References Cited

U.S. PATENT DOCUMENTS 9,803,314 B1 * 10/2017 Zupnick ..... F26B 21/06
2005/0016012 A1 * 1/2005 Yang ..... D06F 73/02 34/486
2021/0115617 A1 * 4/2021 Kang ..... D06F 58/10

FOREIGN PATENT DOCUMENTS

JP 62-173000 A 7/1987
JP 4-317699 A 11/1992
(Continued)

OTHER PUBLICATIONS

International Search Report dated Apr. 19, 2021, issued in International Application No. PCT/KR2020/018953.

*Primary Examiner* — John P McCormack
(74) *Attorney, Agent, or Firm* — Jefferson IP Law, LLP

(57) ABSTRACT

A clothes treating apparatus is provided. The apparatus includes a hanger on which clothes are hung and a blower unit having an air vent for blowing wind toward the clothes hung on the hanger. The hanger includes a supporter connected to the air vent of the blower unit, wherein a wind receiving space is formed inside the supporter, and a shoulder supporter extending from the supporter and forming a wind discharging space connected to the wind receiving space, wherein shoulder portions of the clothes are hung on the shoulder supporter. The wind discharging space includes a body wind path formed to blow wind toward a body portion of the clothes, and sleeve wind paths formed to blow wind toward sleeves of the clothes and diverging at an entrance of the body wind path. The body wind path includes an enlarged wind path portion which is formed at an exit of the body wind path and of which a wind path is enlarged downstream.

19 Claims, 12 Drawing Sheets

(51) Int. Cl.
*D06F 59/02* (2006.01)
*D06F 105/30* (2020.01)
*D06F 105/22* (2020.01)

(58) Field of Classification Search
CPC .. D06F 59/02; D06F 2105/22; D06F 2105/30; D06F 73/02; F26B 9/00
USPC ..... 34/595, 239
See application file for complete search history.

(56) References Cited

FOREIGN PATENT DOCUMENTS

| | | | | | |
|---|---|---|---|---|---|
| JP | 2014-28121 | A | | 2/2014 | |
| JP | 2016-093368 | A | | 5/2016 | |
| KR | 10-2011-0035030 | A | | 4/2011 | |
| KR | 20110035030 | A | * | 4/2011 | |
| KR | 10-1608655 | B1 | | 4/2016 | |
| KR | 10-2017-0080559 | A | | 7/2017 | |
| KR | 10-2019-0084569 | A | | 7/2019 | |
| KR | 10-2019-0128460 | A | | 11/2019 | |
| KR | 102101243 | B1 | * | 11/2019 | ..... A61L 2/07 |
| KR | 10-2101243 | B1 | | 4/2020 | |

* cited by examiner

CLOTHES TREATING APPARATUS

CROSS-REFERENCE TO RELATED APPLICATION(S)

This application is based on and claims priority under 35 U.S.C. § 119(a) of a Japanese patent application number 2019-239542, filed on Dec. 27, 2019, in the Japan Patent Office, and of a Korean patent application number 10-2020-0155335, filed on Nov. 19, 2020, in the Korean Intellectual Property Office, the disclosure of each of which is incorporated by reference herein in its entirety.

BACKGROUND

1. Field

The disclosure relates to a clothes treating apparatus for treating clothes such as shirts hung in the apparatus.

2. Description of Related Art

As a method for smoothing out wrinkles in clothing, there is a method of using a dummy having a cavity. According to the method, the wrinkles of clothes are smoothed out by putting the clothes on a dummy formed with a balloon, etc. and providing steam or dry air inside the dummy. However, because clothes are put on the dummy, clothes to which the method can be applied are limited in size or design.

A method of smoothing out the wrinkles of clothes by motion of a hanger on which the clothes are hung is known. However, the method has a disadvantage in view of a wrinkle removal effect because clothes might swing slightly even when the hanger swings strongly. Also, the method has disadvantages in that it causes great vibrations and noise.

A method of hanging clothes on a hanger and providing warm air is known. For example, a wrinkle removal dryer including a hanger body may have a substantially inverse 'Y' shape. In the wrinkle removal dryer, outlets open at lower portions of both shoulders of the hanger body extending to the left and right sides, and warm air is provided from the outlets.

However, thick clothing may hang down at the sleeves due to its weight and so might not be easily ventilated, so that it is difficult to dry the thick clothing A clothes drying hanger for efficiently drying thick clothes is known and includes a plate-shaped member having air holes, and a pair of separating plates inclined downward from left and right sides of the plate-shaped member.

After clothes are put on the hanger, warm air is supplied upward from the plate-shaped member at the collar. Accordingly, a part of the warm air is supplied to the body portion through the air holes and the remaining part of the warm air is distributed to the separating plates to be supplied to the left and right sleeves.

A plurality of such hangers hang in parallel inside a clothes dryer having a specific structure. Accordingly, the hangers can dry a plurality of pieces of clothes at once.

The present inventors have found that wetting (the process is not required in the case that clothes got wet in advance, for example, after dehydration by a washing machine) clothes and sufficiently moving the entire clothes such that the clothes flap during a drying process is effective to smooth out wrinkles of the clothes (i.e., using a flapping effect).

In contrast, the wrinkle removal dryer of the related art has difficulties in obtaining the flapping effect because warm air is provided from the nearly entire lower portions of both shoulder portions so that strong wind (airflow) does not pass through the center of the body portion. Although increasing air volume can improve the flapping effect, increasing air volume results in disadvantages of increased noise and increased power consumption.

In this sense, the hanger of the related art can distribute air entered into clothes to the left and right sleeves and the body portion. However, the hanger simply distributes air volume, which is accompanied by a reduction of air volume. Furthermore, the warm air that enters the inside of the clothes collides with the plate-shaped member and then is distributed to both the sleeves.

Accordingly, wind power of the warm air distributed to the sleeves is further weakened. That is, the hanger of the related art cannot provide the flapping effect although it can dry thick clothes. Also, increasing air volume results in disadvantages of increased noise and increased power consumption, like the wrinkle removal dryer.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, as aspect of the disclosure is to provide a clothes treating apparatus capable of effectively performing wrinkle removal by causing clothes to flap.

Additional aspects will be set forth in part in the description which follows and, in part, will be apparent from the description, or may be learned by practice of the presented embodiments.

In accordance with an aspect of the disclosure, a clothes treating apparatus is provided. The clothes treating apparatus includes a closet in which a hanger is installed, and capable of automatically smoothing out wrinkles of clothes hung on the hanger.

The clothes treating apparatus may include a blower unit configured to blow wind to inside of the clothes through the hanger.

The hanger may include a supporter extending downward from an air vent positioned in a ceiling of the closet, wherein a wind receiving space receiving wind sent from the blower unit is formed inside the supporter, and a shoulder supporter extending in opposite directions from a lower portion of the supporter, wherein a wind discharging space connected to the wind receiving space is formed inside the shoulder supporter.

Also, a body wind path for blowing wind toward a body portion of the clothes and a pair of sleeve wind paths for blowing wind toward a pair of sleeves of the clothes may be formed in the wind discharging space, and an enlarged wind path portion of which a wind path is gradually enlarged downstream may be formed at an exit of the body wind path.

That is, the clothes treating apparatus may have a function of automatically smoothing out wrinkles of clothes hung on the hanger installed in the closet by humidifying or air-conditioning the closet in response to a control of a button, etc. That is, wind may blow to inside of the clothes hung on the hanger through the wind receiving space in which a wind path for blowing wind toward a body portion of the clothes and a wind path for blowing wind toward sleeves of the clothes are formed.

Accordingly, because wind blows stably to the body portion and sleeves of the clothes, wrinkle removal may be performed uniformly.

Also, because the enlarged wind path portion is formed in a diffuser shape at the exit of the body wind path, air at an entrance of the body wind path may be sucked strongly to the exit so that a flow of air at the entrance is accelerated by so-called the Venturi effect (i.e., according to Bernoulli's theorem) and a large amount of air (wind) may efficiently enter the body wind path.

Accordingly, the body portion and sleeves of the clothes may efficiently flap with limited air volume. As a result, the wrinkles of the clothes may be effectively smoothed out.

The clothes treating apparatus may also include an inhaled air receiving portion which is formed at the entrance of the body wind path and of which a wind path is gradually enlarged upstream.

Flow separation may be suppressed at the entrance so that air (wind) is more smoothly introduced, thereby further improving the Venturi effect. Accordingly, wind may be more efficiently introduced to the body wind path.

Also, the clothes treating apparatus may include a rib positioned on the enlarged wind path portion and extending along the body wind path.

The rib may suppress flow separation in the diffuser shape to cause air to be sucked more strongly to the exit.

The clothes treating apparatus may also include a pair of partition walls that partition the body wind path from the sleeve wind paths in the wind discharging space, and, by the pair of partition walls, entrances of the sleeve wind paths may diverge from the entrance of the body wind path at a boundary between the wind receiving space and the wind discharging space.

Thereby, wind may be efficiently introduced to the sleeve wind paths and the body wind path.

In the clothes treating apparatus, because exits of the sleeve wind paths are respectively positioned at both ends of the shoulder supporters, the exits of the sleeve wind paths may be located below the entrances.

Accordingly, wind flowing along the sleeve wind paths may be smoothly guided to the exits, thereby suppressing deterioration of wind power.

In the clothes treating apparatus, the entrances of the body wind path and the sleeve wind paths may face an opening of the air vent in the up-down direction through the wind receiving space.

Accordingly, wind entered through the air vent may be rectified in the wind receiving space, and enter the body wind path and the sleeve wind paths in the state in which wind power is maintained.

Also, in the clothes treating apparatus, the exits of the sleeve wind paths may be smaller than the entrances of the sleeve wind paths.

Accordingly, wind entered the sleeve wind paths may spurt strongly from the exits.

Also, the clothes treating apparatus may include a foreign material removing portion formed in an upper portion of the supporter and configured to send a part of wind sent from the air vent toward an upper portion of the shoulder supporter.

Thereby, the wind may blow away foreign materials (for example, hair, dandruff, etc.) collected on shoulder portions of the clothes.

The clothes treating apparatus may include a plurality of air vents, and further include an air nozzle detachably attached to one(s) of the air vents together with the hanger. By installing the hanger in one of the air vents being adjacent to each other and installing the air nozzle in the other one of the air vents, the air nozzle may blow wind toward the upper portion of the shoulder supporter of the hanger.

Therefore, an effect of removing foreign materials collected on the clothes may be improved. Also, by spraying wind to the outer side of the clothes, an additional effect may be applied to a flapping effect of the clothes. Accordingly, a clothes treating effect may be further improved.

The clothes treating apparatus may further include a humidification unit for humidifying the closet, and an air conditioner unit for conditioning air of the closet.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Structure of Clothes Treating Apparatus

Figure 1:
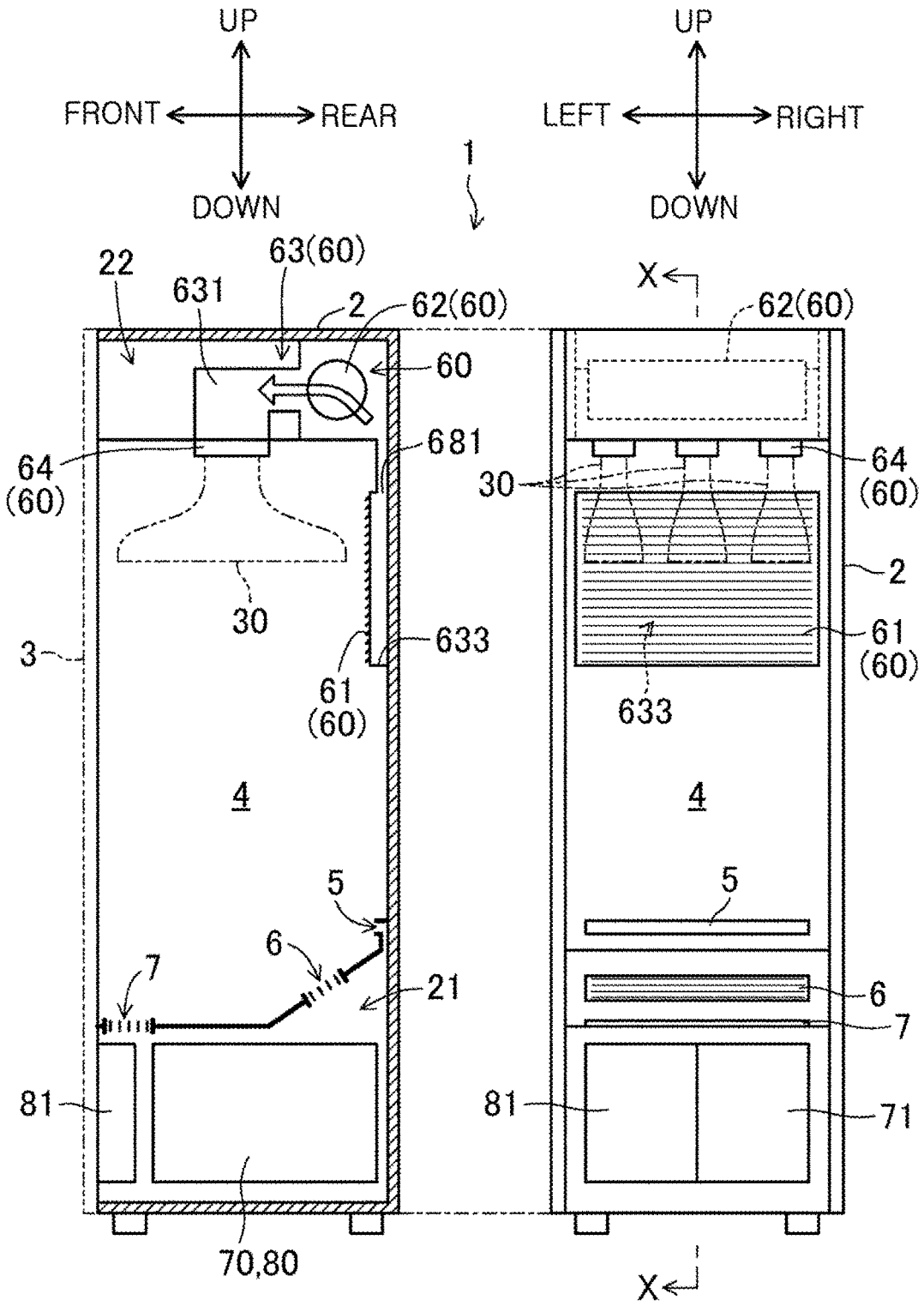
FIG. 1 is a schematic diagram illustrating a structure of a clothes treating apparatus, wherein a right drawing is a front view of the clothes treating apparatus (door is not illustrated) and a left drawing is a schematic cross-sectional view taken along line X-X of the right drawing according to an embodiment of the disclosure.

FIG. 1 is a schematic diagram illustrating a structure of a clothes treating apparatus 1 to which the disclosure is applied according to an embodiment of the disclosure.

Referring to FIG. 1, the clothes treating apparatus 1 may be installed in, for example, a dressing room, a bathroom, a closet, and the like. Also, the clothes treating apparatus 1 may automatically smooth out wrinkles of clothes (tops) C, such as jackets, shirts, etc., in the state in which the clothes are hung on a hanger 30.

Also, the clothes treating apparatus 1 may perform a process of removing foreign materials collected on the clothes C or a bad smell of the clothes C and/or sterilizing the clothes C. That is, the clothes treating apparatus 1 may automatically perform wrinkle removal, foreign material removal, etc. in response to an instruction received through a button control, etc. corresponding to a kind or material of the clothes C.

The clothes treating apparatus 1 may be in a shape of a long box that stands in a vertical direction. The clothes treating apparatus 1 may include a main body 2 that opens at the front side, and a door 3 that rotates to open or close the front side of the main body 2. Inside the clothes treating apparatus 1, a closet 4 may be formed to accommodate clothes C. On a front surface of the door 3, a control panel 8 configured with a button, a touch screen, etc. may be mounted (see FIG. 3).

In a lower portion of the main body 2, a lower space 21 may be provided. In an upper portion of the main body 2, an upper space 22 may be provided. In the upper space 22, a blower unit 60 may be installed. In the lower space 21, a humidification unit 70 and an air conditioner unit 80 may be installed. The closet 4 may be partitioned between the lower space 21 and the upper space 22. On a ceiling surface of the closet 4, a hanger 30 may be attached. In the clothes treating apparatus 1, three hangers 30 may be detachably attached. Examples about each hanger 30 will be described later. However, the number of the hangers 30 that are attachable to the clothes treating apparatus 1 is not limited.

In a bottom of the closet 4, a steam ejecting opening 5, an air ejecting opening 6, and an inhalation opening 7 may be formed. More particularly, the steam ejecting opening 5 and the air ejecting opening 6 may be positioned in a front-rear direction in a rear area of the bottom inclined downward toward a front direction. The inhalation opening 7 may be formed in a front area of the bottom, which is substantially flat.

Figure 2A:
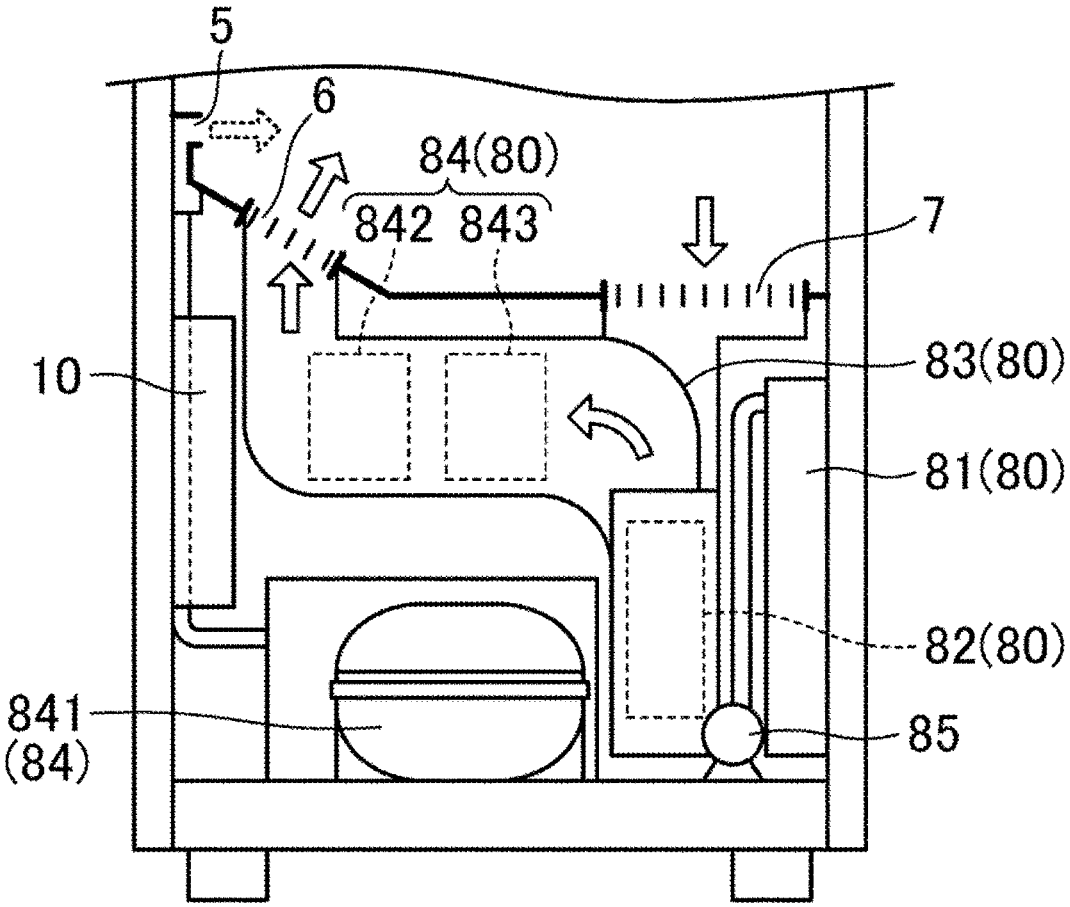
FIG. 2A is a schematic diagram illustrating inside of a lower space from the left according to an embodiment of the disclosure.

FIG. 2A is a schematic diagram illustrating inside of a lower space from the left according to an embodiment of the disclosure.

Figure 2B:
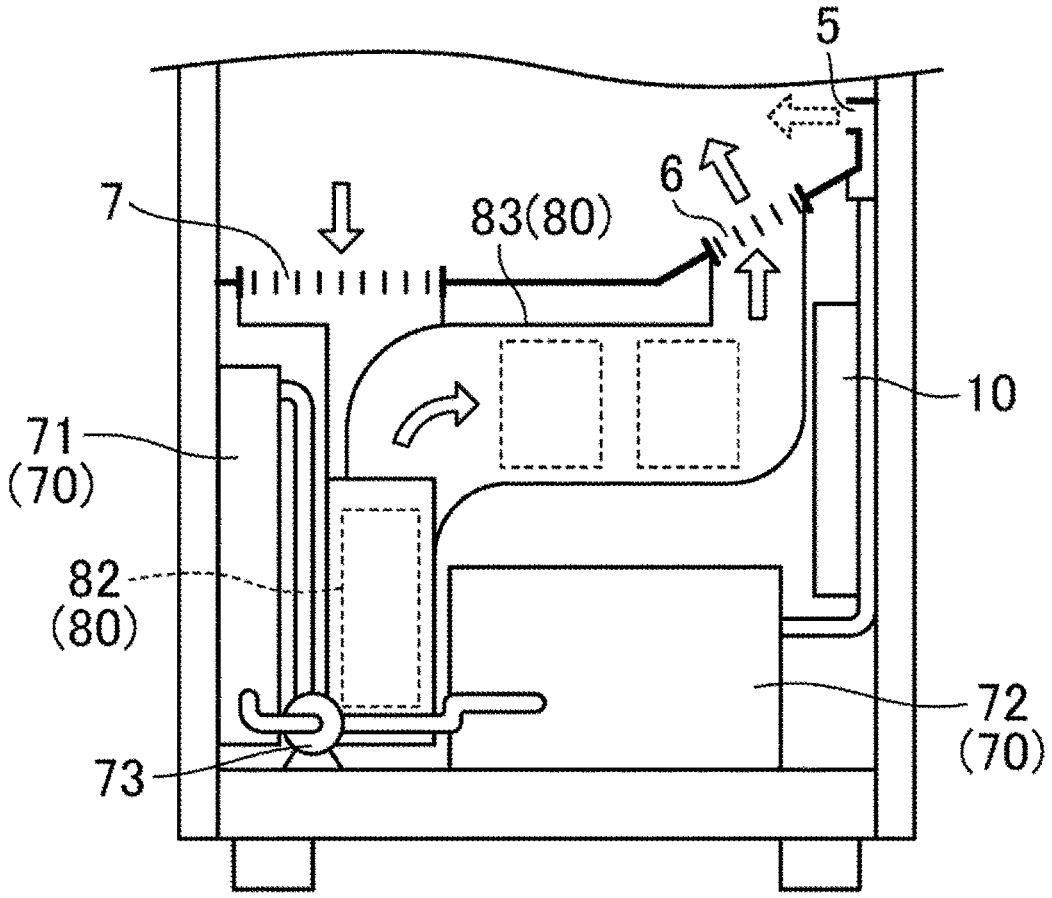
FIG. 2B is a schematic diagram illustrating the inside of the lower space from the right according to an embodiment of the disclosure.

FIG. 2B is a schematic diagram illustrating the inside of the lower space from the right according to an embodiment of the disclosure.

Referring to FIGS. 2A and 2B, the humidification unit 70 may be configured with a water supply tank 71, a steam generator 72, and a water supply pump 73. The air conditioner unit 80 may be configured with a drain tank 81, a circulating fan 82, a circulating duct 83, and a heat exchanger 84. The humidification unit 70 may humidify the closet 4. The air conditioner unit 80 may adjust temperature of air of the closet 4.

Referring to FIG. 1, the drain tank 81 and the water supply tank 71 may be positioned in a front area of the lower space 21. The drain tank 81 and the water supply tank 71 may be detachable from the main body 2. Water stored in the water supply tank 71 may be sent to the steam generator 72 by a water supply pump 73. The steam generator 72 may heat the water through a heater to generate a steam of high-temperature (for example, 100° C.).

The steam generated by the steam generator 72 may be supplied to the closet 4 through the steam ejecting opening 5, as represented by dotted arrows in FIGS. 2A and 2B. The steam may be diffused to the inside of the closet 4 by wind generated by the circulating fan 82 of the air conditioner unit 80.

The heat exchanger 84 may be configured with a compressor 841, a condenser 842, and an evaporator 843. The circulating duct 83 may form a wind path through which air flows to the closet 4 from the lower space 21. The circulating fan 82 may generate wind power for circulating air of the closet 4.

That is, as represented by solid line arrows in FIGS. 2A and 2B, the circulating fan 82 may inhale air of the closet 4 through the inhalation opening 7 to introduce the air to the circulating duct 83, and eject the air introduced to the circulating duct 83 to the closet 4 through the air ejecting opening 6. The air ejected from the air ejecting opening 6 may move upward to traverse the closet 4. The air may arrive at a front and upper space of the closet 4 and fall down to be inhaled to the inhalation opening 7.

The heat exchanger 84 may adjust temperature and humidity of air introduced to the lower space 21 by the circulating fan 82. The heat exchanger 84 may dehumidify and dry air. Also, the heat exchanger 84 may heat air to generate warm air. Accordingly, the circulating fan 82 and the heat exchanger 84 may operate to eject dry and warm air to the closet 4. Condensed water discharged from the air conditioner unit 80 may be sent to the drain tank 81 by a drain pump 85.

In a rear area of the lower space 21, a controller 10 configured with a central processing unit (CPU), a memory, etc. may be installed. The controller 10 may install a control program, etc. to control operations of individual devices included in the clothes treating apparatus 1 according to a control of the control panel 8.

Figure 3:
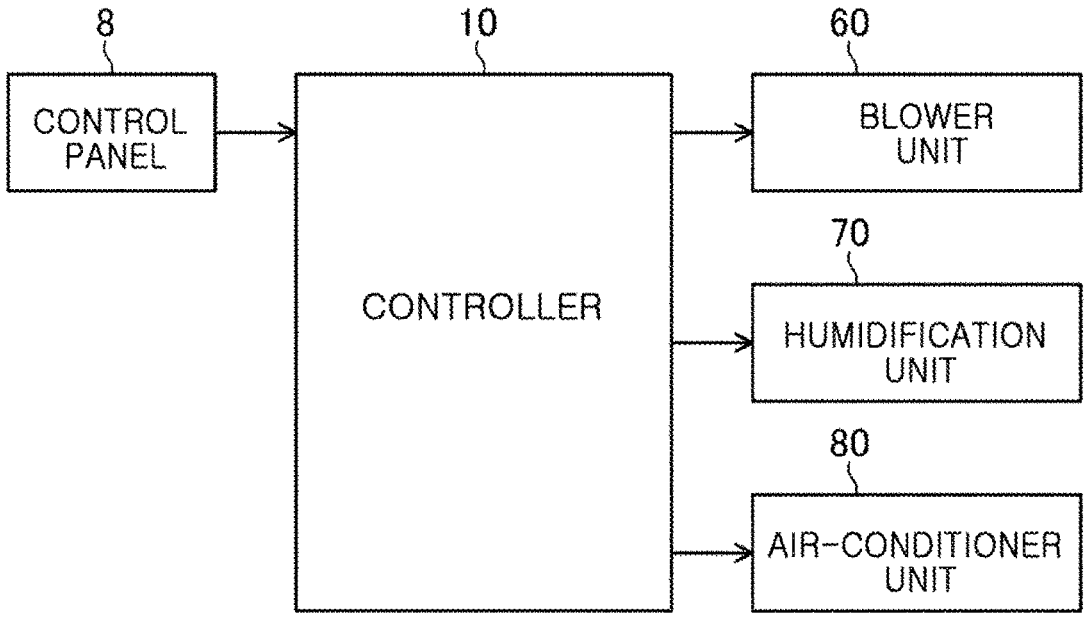
FIG. 3 is a block diagram illustrating a controller and main devices related to the controller according to an embodiment of the disclosure.

FIG. 3 illustrates the controller 10 and main devices for inputting/outputting signals to/from the controller 10 according to an embodiment of the disclosure.

Referring to FIG. 3, the controller 10 may be electrically connected to the control panel 8, the humidification unit 70, the air conditioner unit 80, and the blower unit 60. The controller 10 may select and execute a predefined operation program based on an input signal from the control panel 8. The controller 10 may output electrical signals to the humidification unit 70, the air conditioner unit 80, and the blower unit 60, respectively, according to the operation program, and control operations of the humidification unit 70, the air conditioner unit 80, and the blower unit 60.

Referring to FIG. 1, the blower unit 60 may be configured with a filter 61, a blowing fan 62, a blowing duct 63, and an air vent 64. The blowing duct 63 may include a downstream duct 631 positioned in the upper space 22 of the closet 4, and a upstream duct 681 positioned behind a rear surface of the closet 4.

The blowing fan 62 may be installed between the upstream duct 681 and the downstream duct 631. As a result of an operation of the blowing fan 62, a flow (wind) of air toward the downstream duct 631 from the upstream duct 681 may be formed, as represented by a solid line arrow in FIG. 1.

At an upstream portion of the upstream duct 681, a vent 633 communicating with the closet 4 may be formed. The vent 633 may be positioned at an upper area of the rear surface of the closet 4. The vent 633 may be formed in a shape of a rectangle having a nearly same horizontal width as that of the closet 4. A plate-shaped filter 61 being in a shape of a rectangle may be installed on the rear surface of the closet 4 to cover the vent 633.

Accordingly, a horizontal width of the filter 61 may be at least greater than that of the vent 633 and smaller than that of the rear surface of the closet 4. Also, a vertical width of the filter 61 may be greater than that of the vent 633.

Figure 4:
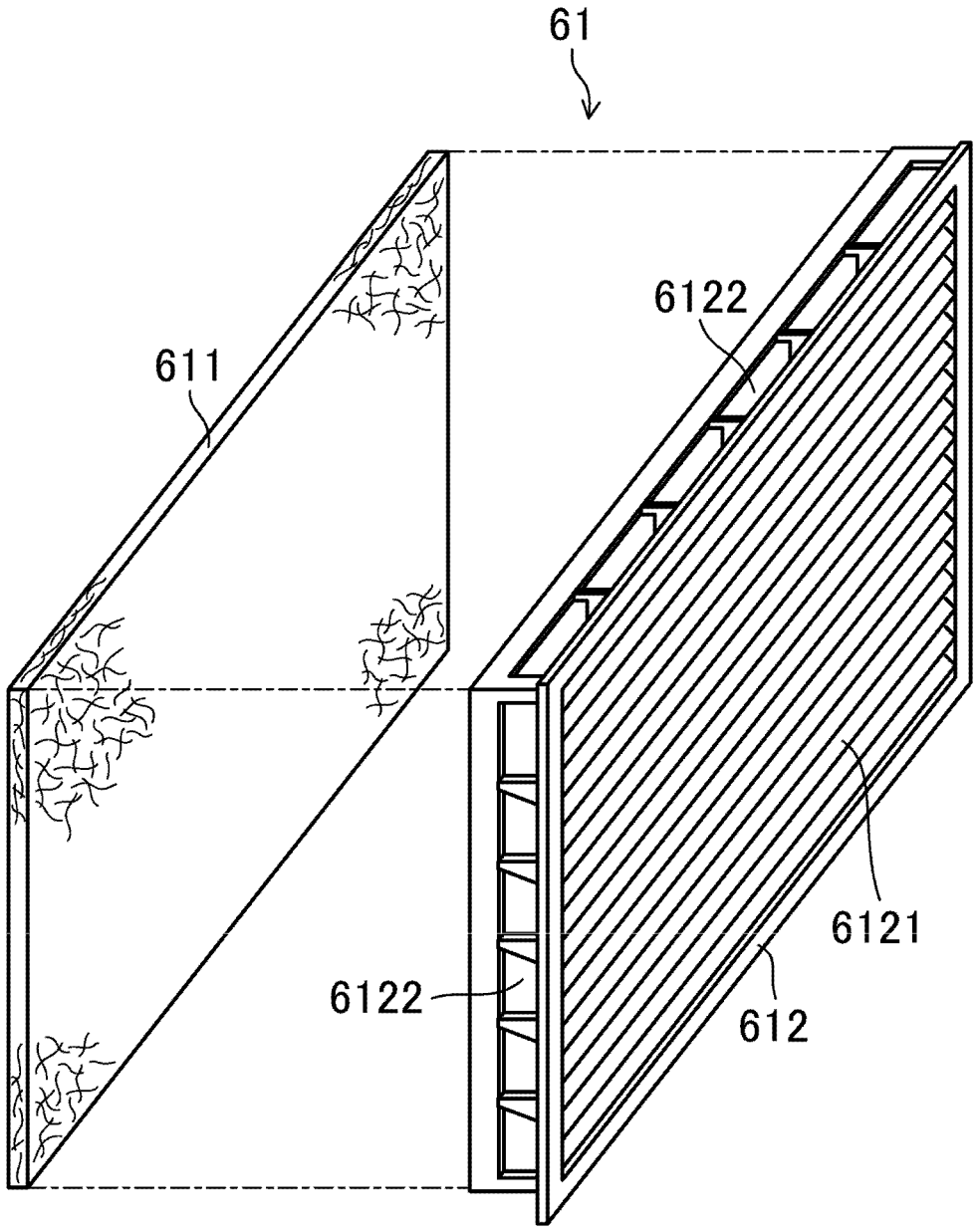
FIG. 4 is an exploded perspective diagram schematically illustrating a structure of a filter according to an embodiment of the disclosure.

FIG. 4 is an exploded perspective diagram schematically illustrating a structure of a filter according to an embodiment of the disclosure.

Referring to FIG. 4, the filter 61 may be configured with a filter material 611 for removing foreign materials, and a filter cover 612 for covering the filter material 611. The filter cover 612 may include a front inhalation portion 6121 in which a plurality of slits are formed in a lattice form in a plurality of blades, and a side inhalation portion 6122 in which a plurality of slits are formed by a plurality of ribs. A flange portion protruding in the front direction from the side inhalation portion 6122 may be formed along edges of the front inhalation portion 6121. The front inhalation portion 6121 may have any other shape through which air enters. The front inhalation portion 6121 may open to the closet 4 in the front direction, and the side inhalation portion 6122 may open to the closet 4 in the up, down, left, and right directions. Accordingly, air of the closet 4 may be inhaled to inside of the filter 61 through the front and side portions of the filter 61.

Air inhaled to the filter 61 may pass through the filter material 611 so that foreign materials such as dust may be removed from the air. The purified air from which foreign materials have been removed may enter the upstream duct 681 through the vent 633 and be sent to the downstream duct 631. A plurality of air vents 64 (in the current embodiment, three air vents) communicating with the closet 4 may be formed at a downstream portion of the downstream duct 631. The air vents 64 may be positioned side by side at intervals in a horizontal width direction (a left-right direction) of the closet 4.

Figure 6:
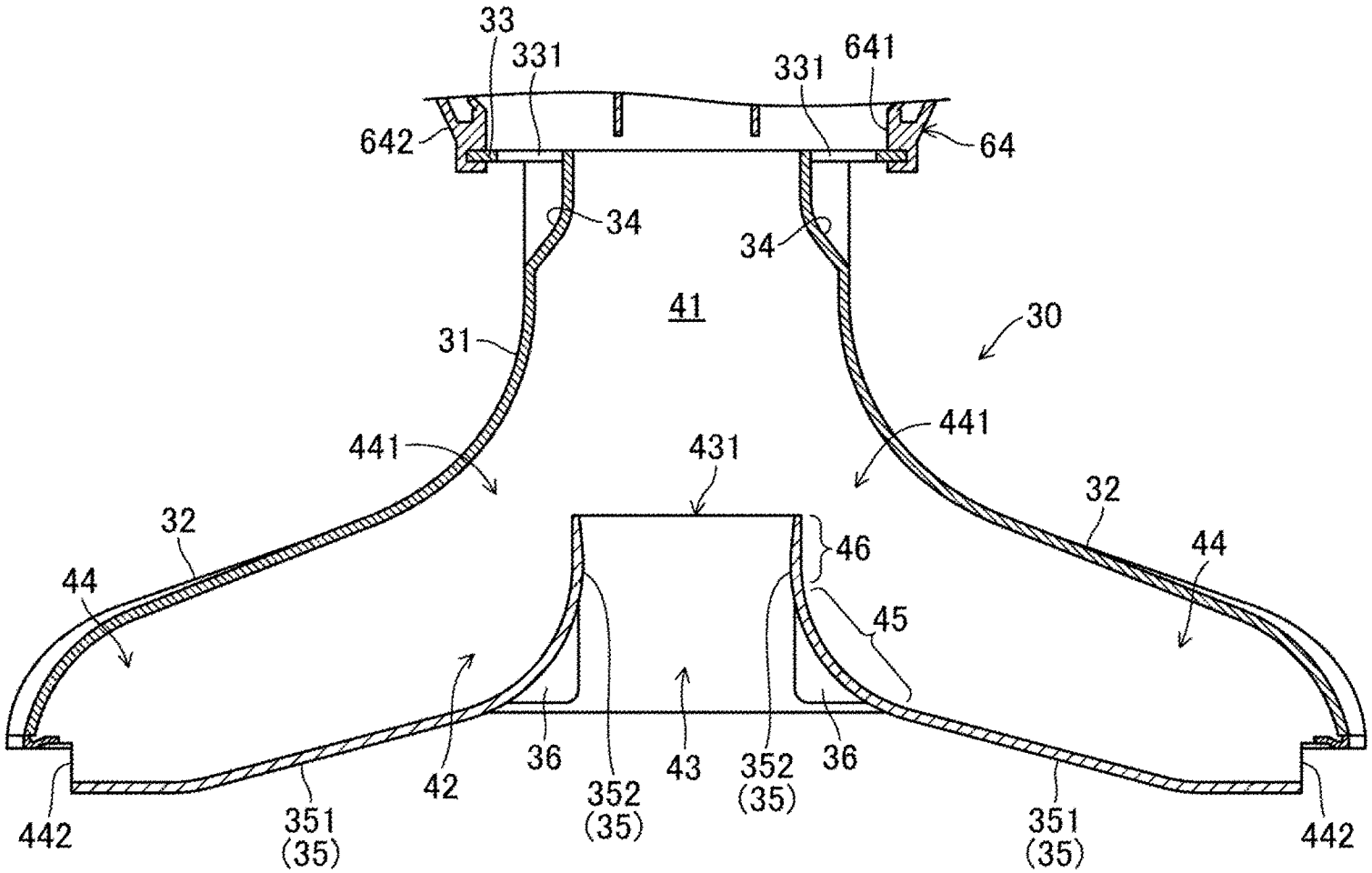
FIG. 6 is a schematic cross-sectional diagram illustrating a state in which a hanger is attached to a ceiling surface of a closet according to an embodiment of the disclosure.
Figure 7:
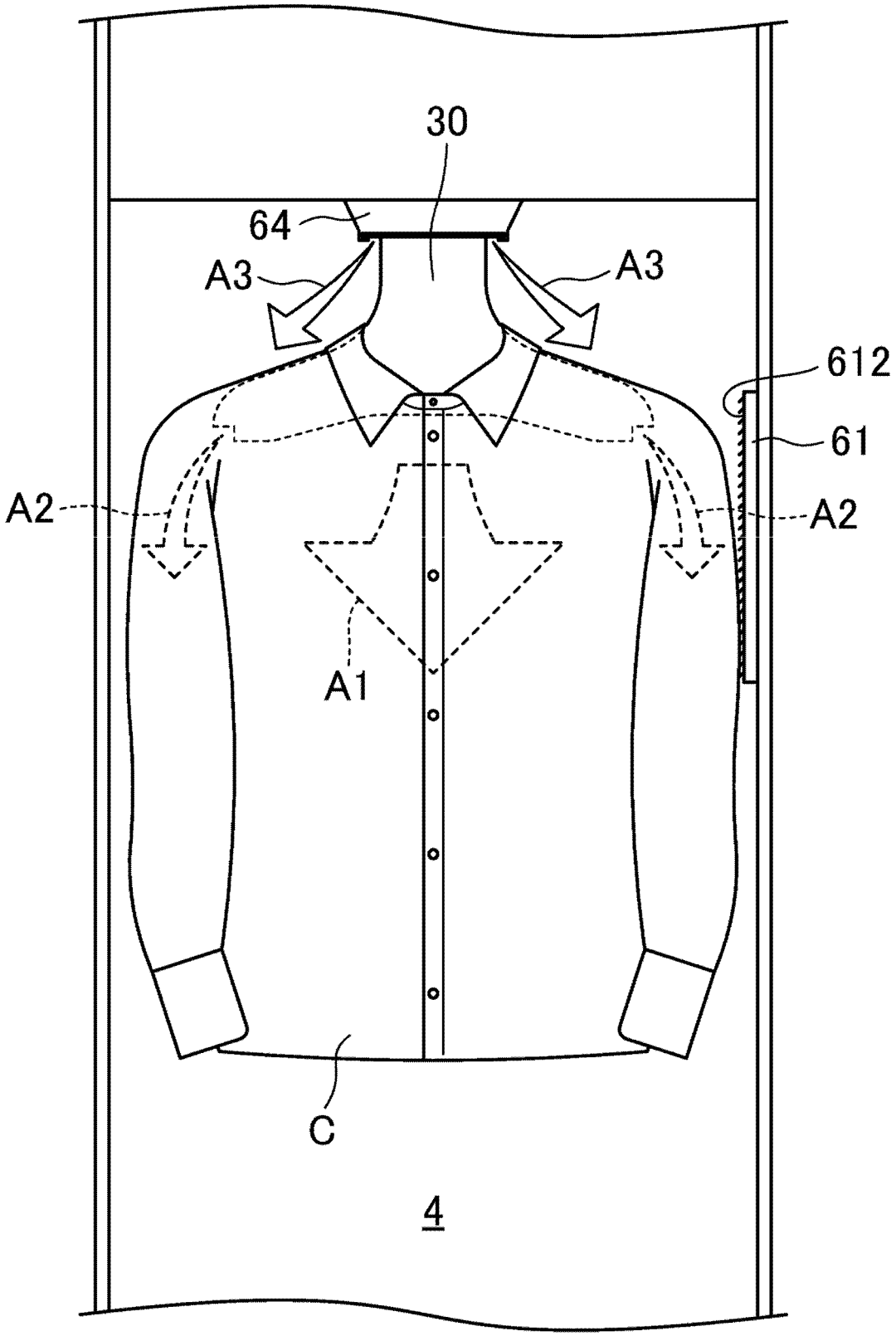
FIG. 7 is a schematic diagram illustrating a case of blowing air to a hanger on which clothes are hung according to an embodiment of the disclosure.

Referring to FIG. 6, each air vent 64 may include an opening 641 formed at the ceiling of the closet 4, and a connecting portion 642 integrated into the opening 641. The opening 641 and the connecting portion 642 may be substantially in a shape of a rectangle extending in the front-rear direction. The hanger 30 on which clothes C are hung may be detachably attached to the air vent 64 through the connecting portion 642. Accordingly, as shown in FIG. 7, the air sent to the downstream duct 631 may blow to inside of the clothes C through the hanger 30 attached to the air vent 64.

Hanger 30

Figure 5:
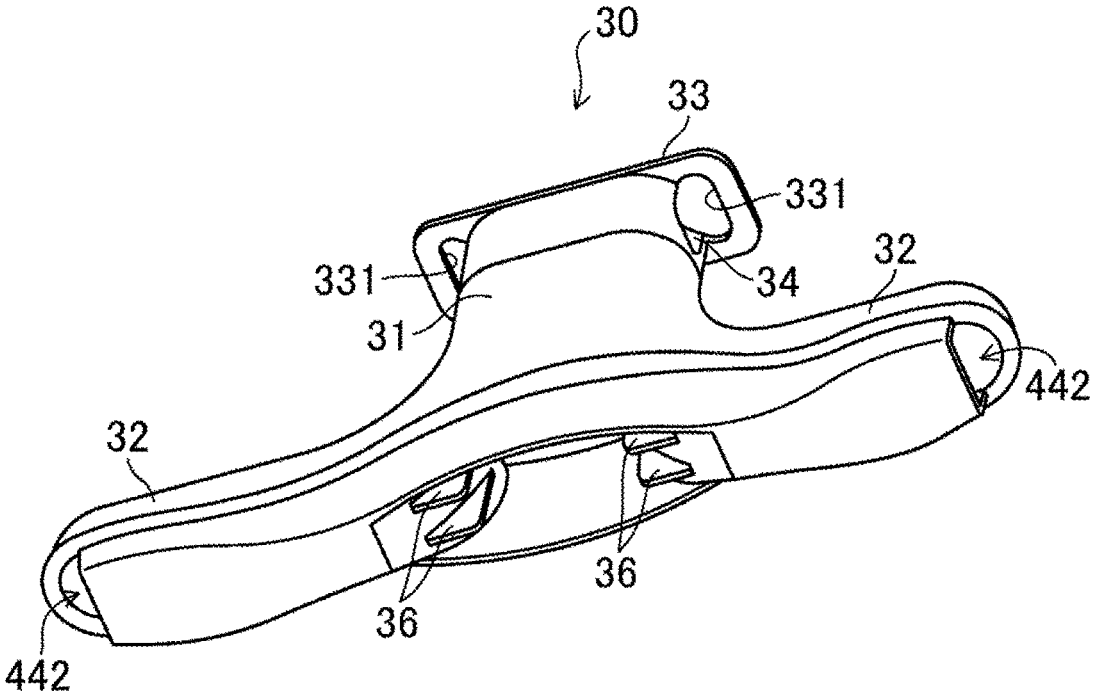
FIG. 5 is a schematic perspective diagram illustrating a hanger according to an embodiment of the disclosure.

FIGS. 5 and 6 illustrate the hanger 30 according to various embodiments of the disclosure.

Referring to FIGS. 5 and 6, the hanger 30 may be a resin molded product. The hanger 30 may have an outer appearance of a substantially inverse Y shape, and have a cavity. More particularly, the hanger 30 attached to the connecting portion 642 may extend downward from the ceiling surface of the closet 4, and include a supporter 31 having a horizontal width (width in front-rear direction) that is greater than a vertical width (a width in left-right direction), and a shoulder supporter 32 slightly inclined downward from a lower portion of the supporter 31 and extending from both sides of the supporter 31.

The supporter 31 may be in a shape of a cylinder, and a wind receiving space 41 of which a cross section is an oval shape may be formed inside the supporter 31. A connector 33 which is in a shape of a thin plate may be provided at a top of the supporter 31. The connector 33 may be in a shape of a rectangle extending in the horizontal width direction. The connector 33 may have the nearly same shape and size as those of the connecting portion 642. The supporter 31 may be detachably attached to the connecting portion 642 by concave-convex coupling.

At an upper end of the supporter 31, a groove portion 34 which is concave upward may be formed. Referring to FIG. 6, each groove portion 34 may be more gently curved at the lower area. At the connector 33, a pair of through holes 331 may be formed to face the groove portion 34 in the up-down direction. An area of each through hole 331 may be smaller than that of an upper opening of the wind receiving space 41 (about ¼ or ⅕).

By attaching the connector 33 to the connecting portion 642 to install the hanger 30 in the closet 4, wind sent to the blower unit 60 through the air vent 64 may be sent to the hanger 30. A main portion of the wind may enter the wind receiving space 41. Also, a part of the wind may enter each groove portion 34 through each through hole 331. The through hole 331 and the groove portion 34 may construct a "foreign material removing portion," which will be described later.

One end of the shoulder supporter 32 may have a cross section of a substantially inverse U shape. Inside the shoulder supporter 32, a wind discharging space 42 connected to the wind receiving space 41 may be formed. Also, a partition wall 35 may be provided below the wind discharging space 42. The partition wall 35 may partition a body wind path 43 for blowing wind toward a body portion of clothes C from a pair of sleeve wind paths 44 for blowing wind toward sleeves of the clothes C.

The partition wall 35 may be coupled with a lower portion of the shoulder supporter 32. However, unlike the current embodiment, the shoulder supporter 32 and the partition wall 35 may be integrated into one body. The wind discharging space 42 may be defined by the shoulder supporter 32 and the partition wall 35.

The partition wall 35 may extend along the lower portion of the shoulder supporter 32. The partition wall 35 may include a sleeve guide wall 351 extending inward from both ends of the shoulder supporter 32 in such a way to be inclined slightly upward, and a body guide wall 352 connected to the sleeve guide wall 351 and extending upward. A pair of body guide walls 352 may be provided, wherein ends of the body guide walls 352 may be positioned at locations at which the shoulder supporter 32 diverges from the supporter 31, and may face each other with a preset interval.

Accordingly, entrances 441 of the sleeve wind paths 44 may diverge from an entrance 431 of the body wind path 43 at a boundary between the wind receiving space 41 and the wind discharging space 42 in the state in which the entrances 441 of the sleeve wind paths 44 are aligned with the entrance 431 of the body wind path 43 in a horizontal direction. The body wind path 43 may be positioned between the sleeve body paths 44, and a center in horizontal width direction of the body wind path 43 may be nearly identical to a center in horizontal width direction of the hanger 30. The sleeve body paths 44 may be symmetrical to each other with respect to a center line thereof.

Also, the entrances 441 and 431 of the body wind path 43 and the sleeve wind paths 44 may face the opening 641 of the air vent 64 in the up-down direction through the wind receiving space 41. Accordingly, wind entered through the air vent 64 may be rectified in the wind receiving space 41, and enter the body wind path 43 and the sleeve wind paths 44 in the state in which wind power is maintained. Also, the body wind path 43 and the sleeve wind paths 44 may be considered to have structures in which wind power sent to the body wind path 43 and the sleeve wind paths 44 does not lose its velocity.

Enlarged Wind Path Portion 45, Inhaled Air Receiving Portion 46

At an exit of the body wind path 43 positioned between the sleeve wind paths 44, an enlarged wind path portion 45 of which a wind path is enlarged downstream may be provided. More particularly, lower portions of the body guide walls 352 and upper portions of the sleeve guide walls 351 extending from the lower portions of the body guide walls 352 may construct the enlarged wind path portion 45, and the enlarged wind path portion 45 may be formed in a shape (a diffuser shape) of which a horizontal width increases gradually.

Accordingly, air at the entrance of the body wind path 43 may be sucked strongly to the exit so that a flow of air at the entrance is accelerated by so-called the Venturi effect and a large amount of air (wind) may efficiently enter the body wind path 43. In addition, the entrances 441 of the sleeve wind paths 44 may be enlarged so that wind may also efficiently enter the sleeve wind paths 44. Exits of the sleeve wind paths 44 may be respectively positioned at both ends of the shoulder supporter 32 located below the entrances 441, as shown in FIGS. 5 and 6.

More particularly, openings (sleeve spurting openings 442) may be formed below the ends of the shoulder supporter 32 connected to ends of the sleeve guide walls 351. Accordingly, wind entered each sleeve wind path 44 may be guided to flow along the sleeve guide wall 351 and spurt from the sleeve spurting opening 442. The wind flowing along each sleeve wind path 44 may flow smoothly to maintain its wind velocity because the wind flows nearly without resistance.

Accordingly, a wind velocity reduction of the body wind path 43 and the sleeve wind paths 44 may be suppressed so that wind may effectively enter the body wind path 43 and the sleeve wind paths 44.

Also, an inhaled air receiving portion 46 may be formed at the entrance of the body wind path 43 such that the body wind path 43 is enlarged upstream. More particularly, upper portions of the body guide walls 352 may construct the inhaled air receiving portion 46, and the inhaled air receiving portion 46 may be formed in a shape of which a horizontal width increases gradually. However, a degree of enlargement of the inhaled air receiving portion 46 may be smaller than that of the enlarged wind path portion 45. By forming the inhaled air receiving portion 46, the Venturi effect may be further improved by a synergy effect with the enlarged wind path portion 45. Accordingly, wind may more efficiently enter the body wind path 43.

In addition, a plurality of ribs (in the current embodiment, two ribs) 36 may be provided on the enlarged wind path portion 45 to extend along the body wind path 43. The ribs 36 may suppress flow separation in the diffuser shape to cause air to be sucked more strongly to the exit.

Also, the sleeve spurting openings 442 of the sleeve wind paths 44 may be smaller than the entrances 441 of the sleeve wind paths 44. Accordingly, wind entered the sleeve wind paths 44 may spurt strongly from the sleeve spurting openings 442. FIG. 7 illustrates a case of blowing air to the hanger 30 on which clothes C are hung. Wind entered the body wind path 43 may strongly enter a body portion of the clothes C and flow toward an end of the clothes C, as represented by an arrow A1.

Together with the flow of the wind, a local flow of wind may be formed inside the body portion so that the body portion of the clothes C may flap. As a result, wrinkles of the body portion of the clothes C may be effectively smoothed out.

Likewise, wind entered the sleeve wind paths 44 may flow strongly along sleeves of the clothes C, as represented by an arrow A2. Thereby, the sleeves of the clothes C may also flap. As a result, wrinkles of the sleeves of the clothes C may be effectively smoothed out.

Also, at the supporter 31 of the hanger 30, the through holes 331 and the groove portions 34 constructing the foreign material removing portion may be provided. Accordingly, a part of wind sent to the hanger 30 may be received by the groove portions 34 through the through holes 331 and thus move toward an upper outer surface of the shoulder supporter 32, as represented by an arrow A3 in FIG. 7. As a result, the wind may blow away foreign materials (for example, hair, dandruff, etc.) collected on shoulder portions of the clothes C.

FIG. 7 is a schematic diagram illustrating a case of blowing air to a hanger on which clothes are hung according to an embodiment of the disclosure.

Also, referring to FIG. 7, there may be a case that, as a result of flapping of the clothes C hung on the hanger 30, the clothes C contacts a front surface of the filter 61. In this case, the clothes C may be adsorbed on the front inhalation portion 6121 of the filter cover 612. The front inhalation portion 6121 of the filter cover 612 may be clogged so that power of wind blowing from the blower unit 60 may deteriorate and a shape of the filter cover 612 may be imprinted on the clothes C.

Against such clogging of the front inhalation portion 6121, the side inhalation portion 6122 may be formed along the edges of the filter cover 612 of the clothes treating apparatus 1, as described above. Because a horizontal width of the filter 61 is nearly equal to a horizontal width of the closet 4, the side inhalation portion 6122 may be prevented from being clogged with the clothes C although the clothes C flaps. Also, the flange portion may prevent the clothes C from being entangled in the side inhalation portion 6122. Accordingly, although the clothes C flaps to contact the front inhalation portion 6121, the clothes C may be prevented from being adsorbed so that the blower unit 60 may output stable wind power and the shape of the filter cover 612 may be prevented from being imprinted on the clothes C due to such adsorption.

Air Nozzle

According to the current embodiment, three air vents 64 may be provided in the closet 4 of the clothes treating apparatus 1, and the hanger 30 may be installed in each of the air vents 64. Accordingly, it may be possible to simultaneously smooth out wrinkles of three pieces of clothes C. Also, the clothes treating apparatus 1 may include an air nozzle 90 as a component together with the hanger 30.

Figure 8A:
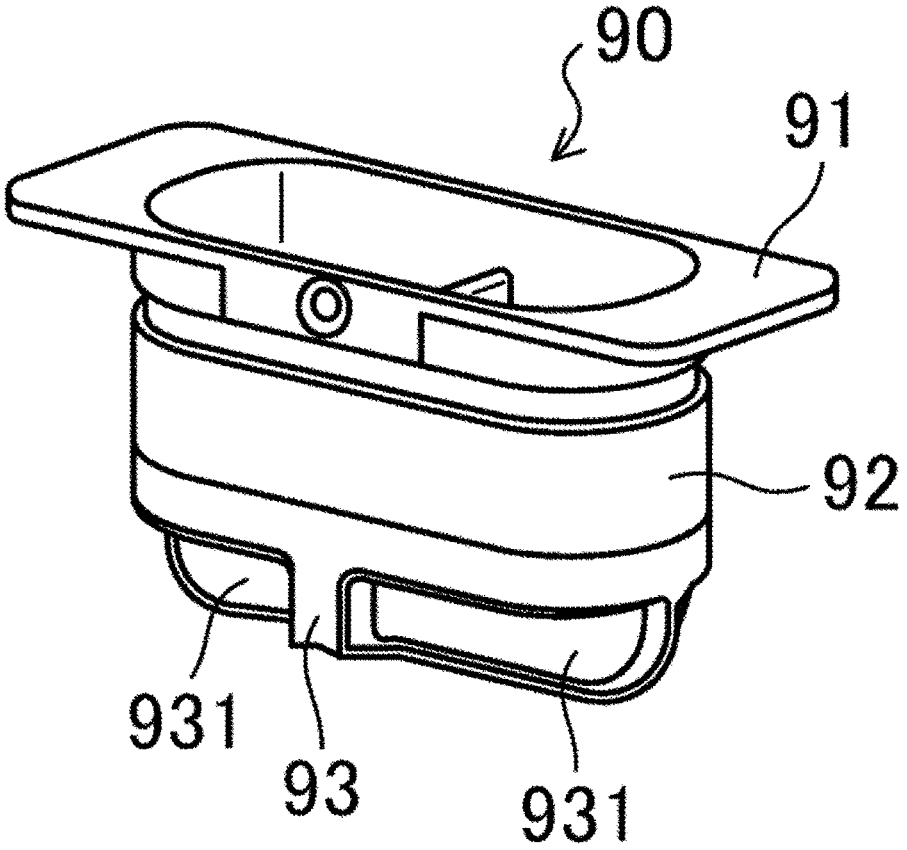
FIG. 8A is a schematic perspective diagram illustrating a dual type air nozzle according to an embodiment of the disclosure.
Figure 8B:
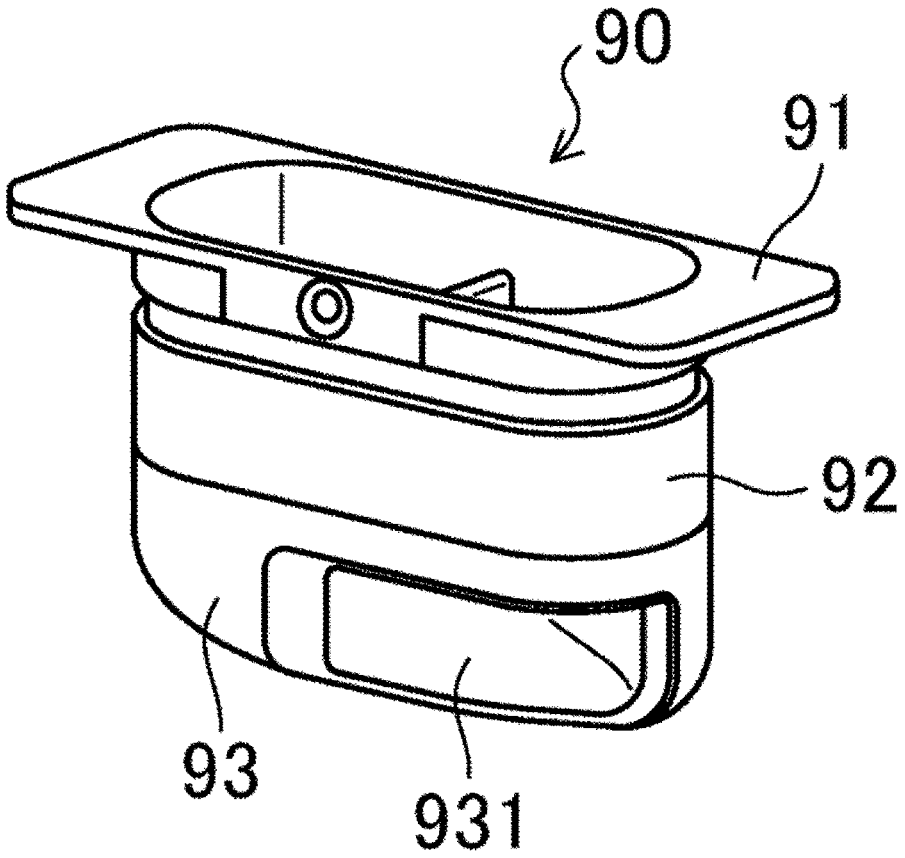
FIG. 8B is a schematic perspective diagram illustrating a single type air nozzle according to an embodiment of the disclosure.

FIGS. 8A and 8B illustrate air nozzles 90 according to various embodiments of the disclosure. FIG. 8A illustrates a dual type air nozzle 90, and FIG. 8B illustrates a single type air nozzle 90. Each of the air nozzles 90 may include a connector 91, a nozzle body 92, and a nozzle cover 93. The connector 91 may have the same structure as the connector 33 of the hanger 30, and may be detachably attached to the connecting portion 642. The nozzle body 92 may be in a shape of a cylinder having a long horizontal width. The nozzle cover 93 may cover a protruding end of the nozzle body 92 to block an entrance of the nozzle body 92.

Referring to FIGS. 8A and 8B, in the dual type air nozzle 90, two spurting openings 931 may be formed side by side in the horizontal width direction. In the single type air nozzle 90, a spurting opening 931 may be formed at one side in horizontal width direction of a nozzle cover 93.

An inner surface of the nozzle cover 93 may be curved. Accordingly, wind entered the nozzle body 92 may be guided along the inner surface of the nozzle cover 93 to spurt in a preset direction from the spurting opening 931.

Figure 9:
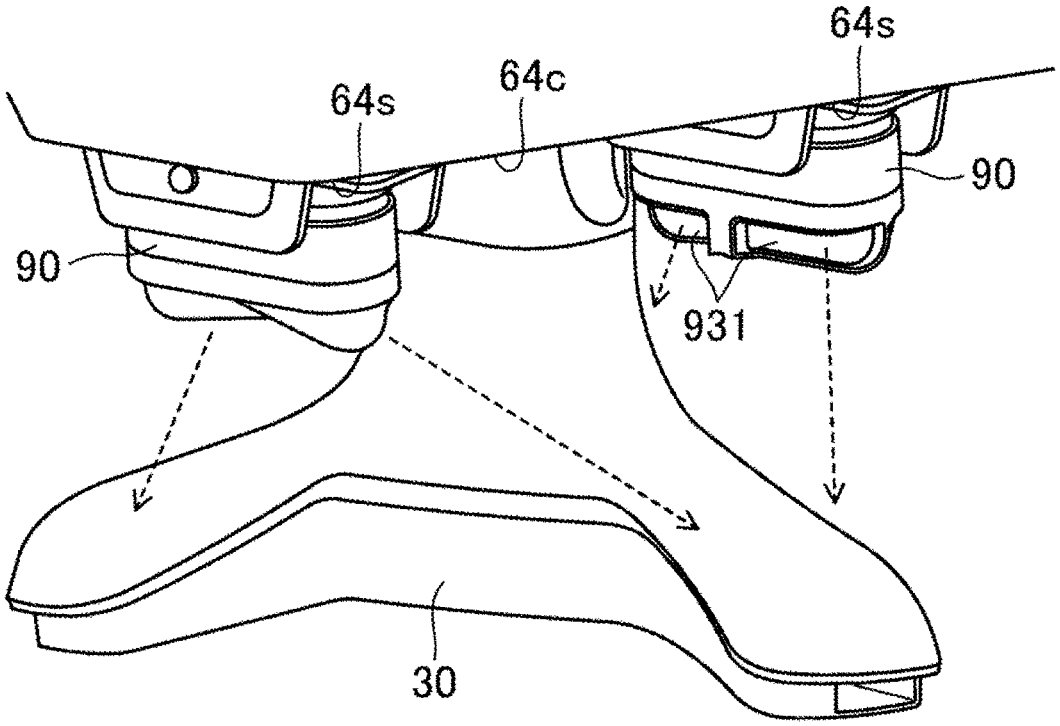
FIG. 9 is a schematic perspective diagram illustrating a use example of a dual type air nozzle according to an embodiment of the disclosure.

FIG. 9 illustrates a use example of the dual type air nozzle 90 according to an embodiment of the disclosure.

Referring to FIG. 9, the air nozzle 90 may be used together with the hanger 30. That is, the hanger 30 may be installed in a center one (a center air vent 64*c*) of the three air vents 64. Two air nozzles 90 may be respectively installed in the remaining two air vents 64 (side air vents 64*s*) being adjacent to the center air vent 64*c* such that the spurting openings 931 are positioned toward the hanger 30.

By installing the air nozzles 90 in this way, wind spurting from the spurting openings 931 may move toward both upper portions of the shoulder supporters 32 of the hanger 30, which is shown by dotted arrows in FIG. 9. In the case of the dual type air nozzle 90, wind may spurt toward the upper portions of the shoulder supporter 32 from one air nozzle 90. More particularly, wind may traverse a neck of clothes C hung on the hanger 30 and spurt toward shoulder portions of the clothes C.

In the case of the single type air nozzle 90, wind may spurt from the air nozzle 90 toward one upper portion of the shoulder supporter 32. By installing two single type air nozzles 90, wind may spurt from the respective air nozzles 90 toward the respective upper portions of the shoulder supporter 90.

By using a combination of such air nozzles 90 for the hanger 30, an effect of removing foreign materials collected on clothes C may be improved. Also, by blowing wind to an outer side of the clothes C, the clothes C may flap more. Thereby, an effect of caring the clothes C may be raised. A direction in which wind spurts from the spurting opening 931 of the air nozzle 90 may change according to a specification. For example, the spurting opening 931 of the air nozzle 90 may be positioned toward a center portion in horizontal width direction of the hanger 30 such that wind contacts a back of clothes C.

Control Example of the Clothes Treating Apparatus 1

Figure 10:
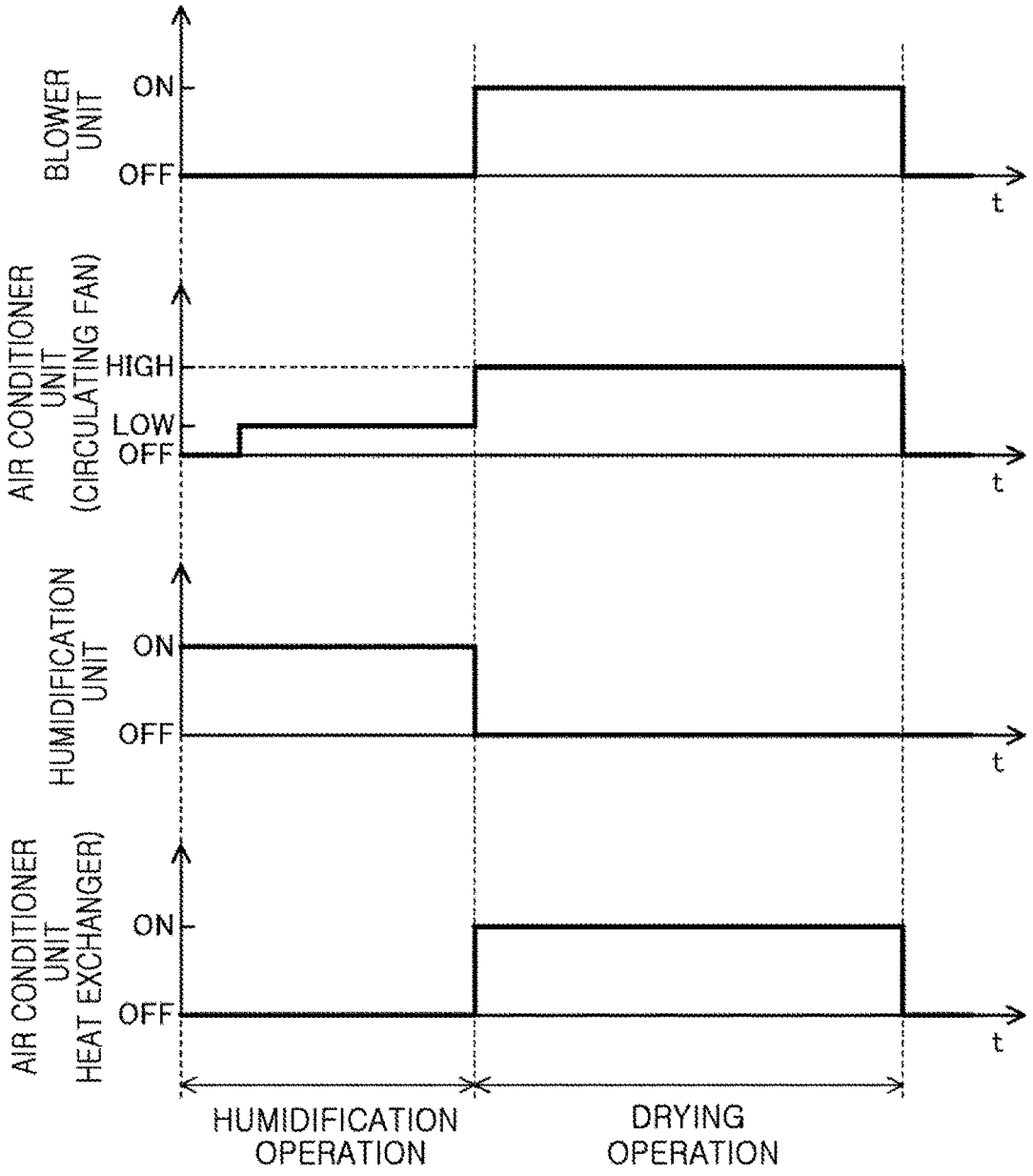
FIG. 10 is time charts of main devices for describing a control example of wrinkle removal that is performed by a clothes treating apparatus according to an embodiment of the disclosure.

FIG. 10 illustrates a control example of wrinkle removal that is performed by the clothes treating apparatus 1 according to an embodiment of the disclosure.

Referring to FIG. 10, a user may supply water to the water supply tank 71 and drain water stored in the drain tank 81 before operating the clothes treating apparatus 1. The user may hang clothes C on the hanger 30 installed in the closet 4 and close the door 3. The user may control the control panel 8 to select a mode that is suitable for the clothes C, and start an operation of the clothes treating apparatus 1.

Accordingly, the controller 10 may execute a treating process configured with a humidification operation and a drying operation. More particularly, the controller 10 may operate the humidification unit 70. Thereby, water stored in the water supply tank 71 may be sent to the steam generator 72 via the water supply pump 73. The steam generator 72 may heat the water to generate a steam of high temperature (for example, 100° C.). The steam generated by the steam generator 72 may be sprayed to the closet 4 through the steam ejecting opening 5.

The controller 10 may operate the circulating fan 82 of the air conditioner unit 80 simultaneously with or a little later than the spraying of the steam. The controller 10 may operate the circulating fan 82 a little later than the spraying of the steam to suppress dew condensation and efficiently humidify the clothes C.

A revolutions per minute (rpm) of the circulating fan 82 may be controllable, and, in the control example, the rpm of the circulating fan 82 may be controlled to a high level and a low level. The controller 10 may operate the circulating fan 82 at a low rpm. Thereby, the steam may be diffused to the inside of the closet 4 by wind generated by the circulating fan 82. Accordingly, after a preset time elapses, the clothes C may become appropriately humid, and the controller 10 may change the humidification operation to the drying operation.

In the drying operation, the controller 10 may stop operating the humidification unit 70. The controller 10 may raise the rpm of the circulating fan 82 to operate the heat exchanger 84. Accordingly, air passed through the heat exchanger 84 may be dehumidified and dried. Also, while the air is heated, warm air may be generated so that dried warm wind may spurt to the closet 4. As a result, air of the closet 4 may be exchanged to gradually get dried.

Also, in the drying operation, the controller 10 may operate the blower unit 60. A rpm of the blower unit 60 installed in the upper space 22 may be controllable, and may be controlled to an optimal rpm according to a material of clothes or a progress of operations. In the control example, the optimal rpm may be a preset rpm. Accordingly, air of the closet 4, passed through the filter 61, may blow to the inside of the clothes C through the hanger 30. Accordingly, the clothes C may flap. During the drying operation, the blower unit 60 may operate at all times so that the clothes C may be gradually dried while flapping. As a result, wrinkles of the clothes C may be effectively removed.

After a preset time elapses, the clothes C may be completely dried so that the controller 10 may stop operating, and notify that the treating process has terminated through an alarm such as ringing a buzzer. As such, according to the clothes treating apparatus 1, because deterioration of wind velocity is suppressed by studying a structure of the hanger 30, the clothes treating apparatus 1 may cause clothes C to flap effectively without excessively increasing air volume. As a result, wrinkle removal may be effectively performed.

The clothes treating apparatus 1 according to the disclosure is not limited to the above-described embodiments, and may include various other components.

For example, the humidification unit 70 may generate a mist instead of a steam as long as the humidification unit 70 is capable of humidifying the inside of the closet 4. The hanger 30 or the air nozzle 90 may be fixed to the ceiling surface of the closet 4 in such a way to be not detached from the ceiling surface of the closet 4. Also, a cap for closing the air vent 64 may be provided as a component.

The rpm of the blower fan 62 may be controllable, and in the earlier stage of the drying operation, the blower fan 62 may rotate at a higher rpm than in the later stage of the drying operation. Increasing humidity of clothes may be efficient in view of a wrinkle removal effect. Also, soft clothes or thin clothes may be processed at a low rpm of the blower fan 62, and hard clothes or thick clothes may be processed at a high rpm of the blower fan 62.

Also, a driving mode for the blower unit 60 may be provided separately. In this case, foreign materials collected on clothes may be effectively removed.

According to the clothes treating apparatus to which the disclosure is applied, wrinkle removal may be effectively performed by causing clothes to flap.

While the disclosure has been shown and described with reference to various embodiments thereof, it will be understood by those skilled in the art that various changes in form and details may be made in therein without departing from the spirit and scope of the disclosure as defined by the appended claims and their equivalents.

What is claimed is:

1. A clothes treating apparatus comprising:

a main body;

a hanger positioned inside the main body, wherein the hanger is configured for clothes to be hung on the hanger; and a blower unit having an air vent through which wind blows toward the clothes hung on the hanger, wherein the hanger comprises:

a supporter connected to the air vent, wherein a wind receiving space is formed inside the supporter, a shoulder supporter extending from the supporter and forming a wind discharging space connected to the wind receiving space, and a partition wall coupled with a lower portion of the shoulder supporter and forming the wind discharging space together with the shoulder supporter, wherein shoulder portions of the clothes are hung on the shoulder supporter, wherein the wind discharging space comprises:

a body wind path formed to blow wind toward a body portion of the clothes; and sleeve wind paths formed to blow wind toward sleeves of the clothes and diverging at an entrance of the body wind path, and wherein the body wind path comprises an enlarged wind path portion which is formed at an exit of the body wind path and of which a wind path is enlarged downstream.

2. The clothes treating apparatus of claim 1, wherein the body wind path comprises an air receiving portion which is formed at an entrance of the body wind path and of which the wind path is enlarged upstream.

3. The clothes treating apparatus of claim 1, wherein, in the enlarged wind path portion, a rib is formed to extend along the wind path of the enlarged wind path portion.

4. The clothes treating apparatus of claim 1, wherein the partition wall divides the wind discharging space into the body wind path and the sleeve wind paths.

5. The clothes treating apparatus of claim 1, wherein the body wind path and the sleeve wind paths diverge at a boundary between the wind receiving space and the wind discharging space.

6. The clothes treating apparatus of claim 1, wherein exits of the sleeve wind paths are smaller than entrances of the sleeve wind paths.

7. The clothes treating apparatus of claim 1, wherein the air vent comprises an opening through which wind is discharged, and a connecting portion formed around the opening, wherein the hanger is connected to the connecting portion, and wherein the supporter comprises a connector detachably attached to the connecting portion.

8. The clothes treating apparatus of claim 7, wherein, at the connector, a through hole is formed to blow a part of wind discharged through the air vent toward an upper outer surface of the shoulder supporter.

9. The clothes treating apparatus of claim 8, wherein the supporter comprises a groove portion formed to be concave at a location corresponding to the through hole to guide air discharged through the through hole to the upper outer surface of the shoulder supporter.

10. The clothes treating apparatus of claim 8, wherein an area of the through hole is ¼ to ⅕ of an area of an upper opening of the wind receiving space.

11. The clothes treating apparatus of claim 1, wherein the blower unit comprises a vent through which air is inhaled, and a filter installed at the vent, wherein the filter comprises a filter material for removing foreign materials, and a filter cover for covering the filter material, and wherein the filter cover comprises a front inhalation portion facing a front surface of the filter material and a side inhalation portion facing the filter material in peripheral directions of the filter material.

12. The clothes treating apparatus of claim 1, wherein a plurality of air vents are provided, wherein the hanger is installed in at least one of the plurality of air vents, and wherein an air nozzle is installed in at least one of the remaining air vents and is configured to guide wind toward the clothes hung on the hanger.

13. The clothes treating apparatus of claim 12, wherein each of the plurality of air vents comprises a connecting portion to which one of the hanger or the air nozzle is connected, and wherein each of the hanger and the air nozzle comprises a connector detachably attached to the connecting portion.

14. The clothes treating apparatus claim 1, wherein the supporter comprises a foreign material removing portion configured to blow a part of wind entered through the air vent toward an outer side of the clothes.

15. The clothes treating apparatus of claim 14, wherein the foreign material removing portion comprises a through hole formed in the supporter and configured to blow the part of the wind entered through the air vent toward an upper outer surface of the shoulder supporter.

16. The clothes treating apparatus of claim 15, wherein the foreign material removing portion further comprises a groove portion formed in the supporter and configured to guide air discharged through the through hole to the upper outer surface of the shoulder supporter.

17. The clothes treating apparatus of claim 16, wherein the groove portion is formed to be concave at a location corresponding to the through hole.

18. The clothes treating apparatus of claim 1, further comprising a humidification unit configured to humidify air in the clothes treating apparatus.

19. The clothes treating apparatus of claim 1, further comprising an air conditioner unit, wherein the air conditioner unit is configured to dehumidify air in the clothes treating apparatus and is configured to adjust a temperature of air in the clothes treating apparatus.

* * * * *